US005619874A

United States Patent [19]

Myers

[11] Patent Number: 5,619,874

[45] Date of Patent: Apr. 15, 1997

[54] HANDLE LOCK FOR SAFE DOORS AND THE LIKE

[75] Inventor: Gary L. Myers, Monee, Ill.

[73] Assignee: Fort Lock Corporation, River Grove, Ill.

[21] Appl. No.: 659,231

[22] Filed: Jun. 5, 1995

Related U.S. Application Data

[63] Continuation of Ser. No. 301,804, Sep. 7, 1994, abandoned.

[51] Int. Cl.[6] ..... E05B 15/16

[52] U.S. Cl. ..... 70/422; 70/189; 70/369

[58] Field of Search ..... 70/189, 222, 223, 70/284, 367, 369, 370, 422, 452, 490; 109/61

[56] References Cited

U.S. PATENT DOCUMENTS

| | | | |
|---|---|---|---|
| 2,206,462 | 7/1940 | Jacobi | 70/490 |
| 3,733,865 | 5/1973 | Vorob | 70/370 |
| 4,712,400 | 12/1987 | Steinbach | 70/369 |
| 4,773,240 | 9/1988 | Foshee | 70/222 |
| 4,998,953 | 3/1991 | Wilkin | 70/452 |
| 5,010,755 | 4/1991 | Best | 70/422 |

*Primary Examiner*—Steven N. Meyers
*Assistant Examiner*—Donald J. Lecher
*Attorney, Agent, or Firm*—Leydig, Voit & Mayer, Ltd

[57] ABSTRACT

A handle lock for use on safe doors and the like is provided including a lock shell, a lock plug, a shaft and a handle. The lock shell is formed with a smooth cylindrical outer surface and a central throughbore adopted to receive the lock plug. To provide for selective rotation of the lock plug within the lock shell, the lock plug includes tumbler means which engage with longitudinal lock grooves formed in the lock shell. A shaft connects the lock plug to a crank which translates the rotary motion of the lock plug into the operation of the door latches. The handle is provided with a mounting throughbore formed with an internal annular ledge. The annular ledge has multiple connecting splines which interlock with complemental connecting splines on an annular flange on the lock plug when the lock plug is inserted into the mounting throughbore. The sides of the complemental positioning splines are tapered so that they will slide out of engagement if a significant force is applied to the handle while the tumbler means are engaged with the locking grooves. The handle is also provided with positioning splines formed on the rear face of the mounting throughbore. These positioning splines engage with complemental positioning splines formed on the face of the lock shell when the handle is turned into either the open or closed position.

5 Claims, 5 Drawing Sheets

HANDLE LOCK FOR SAFE DOORS AND THE LIKE

This is a continuation of application Ser. No. 8/301,804 filed on Sep. 7, 1994, now abandoned.

BACKGROUND OF THE INVENTION

1. Field of the invention

This invention relates generally to the field of combinating tumbler locks, and more particularly to tumbler locks used on safe doors and the like.

2. Description of the Prior Art

There are many combinating tumbler handle locks in the prior art which can be used on a safe door or the like. However, many of these have drawbacks which make them undesirable.

A common problem with combinating tumbler locks is that they are vulnerable to being forced open by individuals not possessing a key. When the handle lock is used in conjunction with a combination lock on a safe door, this could create undesirable security problems. For example, in an office environment it is often inconvenient for employees to dial the combination each time they wish to open the safe. Therefore, frequently, the safe's combination lock is unlocked at the beginning of the day and for the remainder of the day the safe is opened and closed using only the key-actuated handle lock. While this arrangement may be convenient, it places the contents of the safe in a vulnerable position. With typical combinating tumbler handle locks, the handle is rigidly connected to the lock plug and if a significant force is exerted on the handle when the tumblers are engaged with the lock shell the tumblers may shear within the lock shell. Once the tumblers have sheared, the lock plug might rotate freely within the lock shell and the safe can be opened without the use of the key. Worse yet, application of such a force may result in a jamming or breaking of the handle, resulting in lockout.

Another common problem with combinating tumbler handle locks is that the handle rotates loosely after the key has been inserted in the lock. This loose rotation can result in difficulty in locating the open and closed positions of the handle lock. In addition, the loose rotation may make it difficult to keep the handle accurately aligned in the open and closed positions after the key has been inserted. Thus, this loose rotation makes these locks inconvenient to use.

SUMMARY OF THE INVENTION

Accordingly, it is a primary object of the present invention to overcome the deficiencies in the existing combinating tumbler handle locks by providing a tumbler handle lock that cannot be forced open through the exertion of a significant turning force on the handle when the tumblers are engaged with the lock shell.

It is an additional object to provide a tumbler handle lock that allows the handle to be accurately aligned and held in either the open or closed position when the key is inserted.

It is an additional object to provide a tumbler handle lock that has a simple construction and a low manufacturing cost.

In accordance with these and other objects, there is provided a novel lock construction primarily for use on safe doors and the like. The handle lock primarily consists of a lock shell, a lock plug, a shaft and a handle. The lock shell is formed with a smooth cylindrical outer surface and a central throughbore adapted to receive the lock plug. The lock plug includes tumbler means which engage with longitudinal lock grooves formed in the lock shell in order to provide for selective rotation of the lock plug within the lock shell. A shaft connects the lock plug to a crank. Several links are pivotally connected to the crank and to the door latches in order to translate the rotary motion of the lock plug into the operation of the door latches. The handle is provided with a mounting throughbore formed with an internal annular ledge. To provide for the connection of the handle to the lock plug, a breakaway interlocking connection is used. The annular ledge has multiple connecting splines which interlock with complemental connecting splines on an annular flange on the lock plug when the lock plug is inserted into the mounting throughbore. The sides of the connecting interlocking splines are tapered so that they will cam and slide out of engagement if a significant force is applied to the handle when the tumbler means are engaged with the locking grooves. To provide for accurate positioning of the handle in the open and closed position, the handle is provided with positioning splines formed on the rear face of the mounting throughbore. These positioning splines engage with complementary positioning splines formed on the face of the lock shell when the handle is turned into either the open or closed position.

DETAILED DESCRIPTION OF THE PREFERRED EMBODIMENT

While the invention will be described in connection with a particular preferred embodiment, it will be understood that it is not intended to limit the invention to that particular embodiment. On the contrary, it is my intention to cover all alternatives, modifications and equivalences that may be included within the spirit and scope of the invention as defined by the appended claims.

Figure 1:
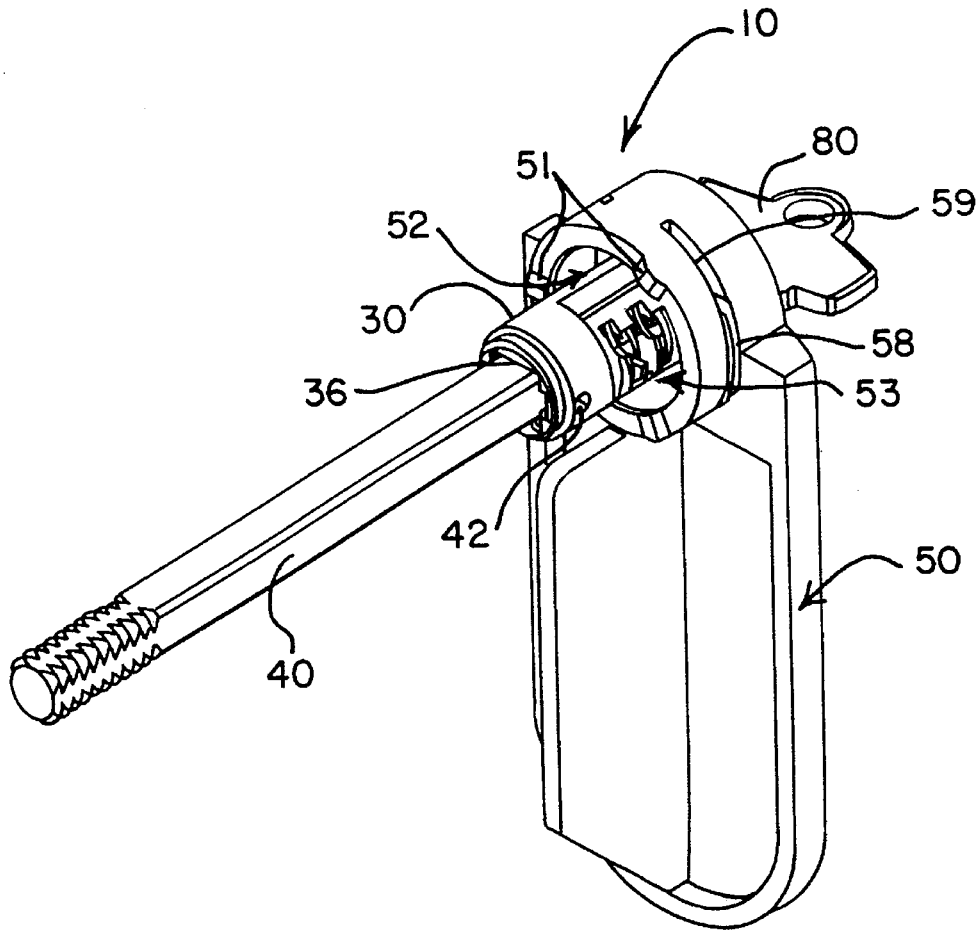
FIG. 1 is a perspective view of the handle, lock plug and shaft of one embodiment of the handle lock.
Figure 2:
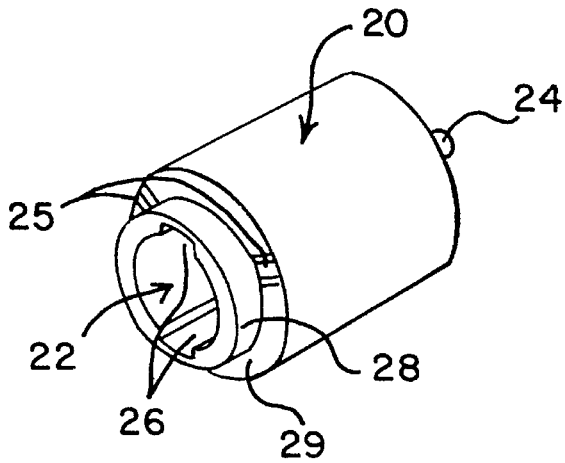
FIG. 2 is a perspective view of the lock shell of one embodiment of the handle lock.
Figure 3:
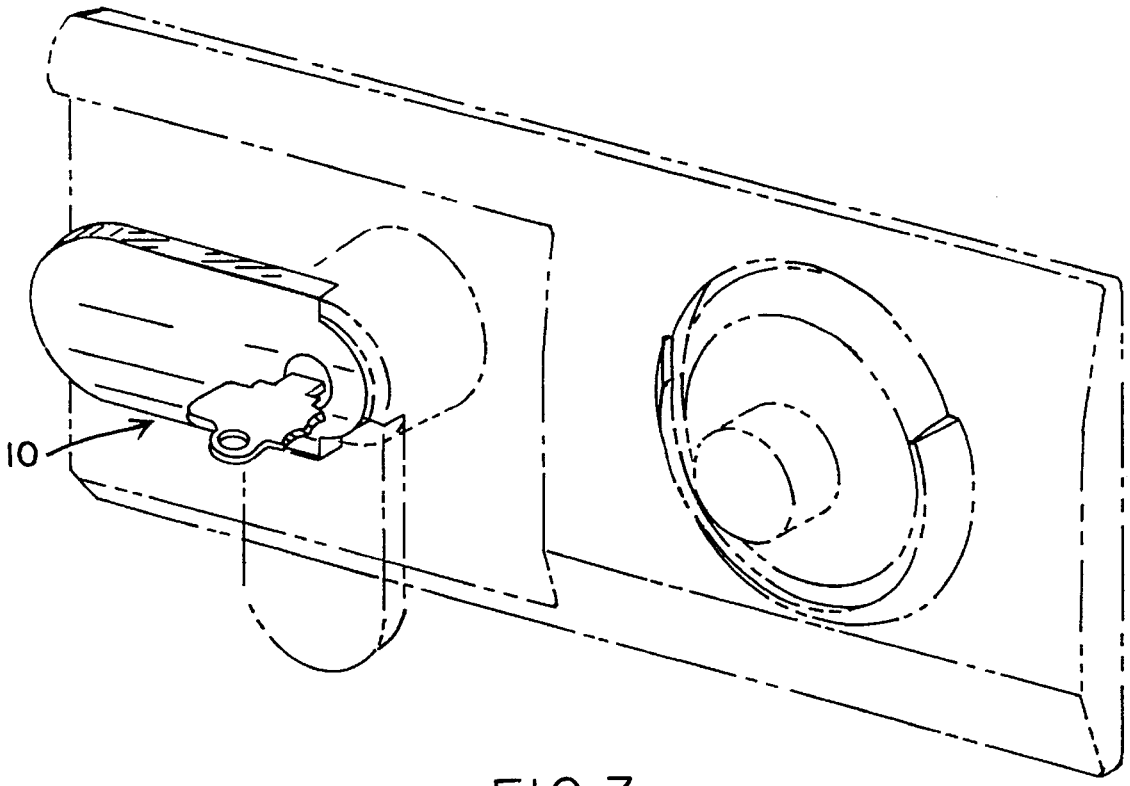
FIG. 3 is an environmental drawing showing the handle lock in its housing alongside a combination lock in one embodiment of the handle lock.

Turning to the drawings, there is shown in FIGS. 1 and 2 a handle lock 10 manufactured in accordance with the present invention. As can be seen from these figures, the lock is a simple construction consisting of relatively few parts. These parts include a lock shell 20, a lock plug 30, a shaft 40 and a handle 50.

The lock shell 20 has a substantially smooth cylindrical outer surface and a central throughbore 22. The central throughbore 22 is adapted to receive a lock plug 30. In addition, to facilitate mounting of the lock shell 20 onto a safe door or the like, the lock shell 20 incorporates multiple mounting posts 24. One skilled in the art will appreciate that several other means of mounting the lock shell 20 on a safe door or the like could be used.

Figure 5:
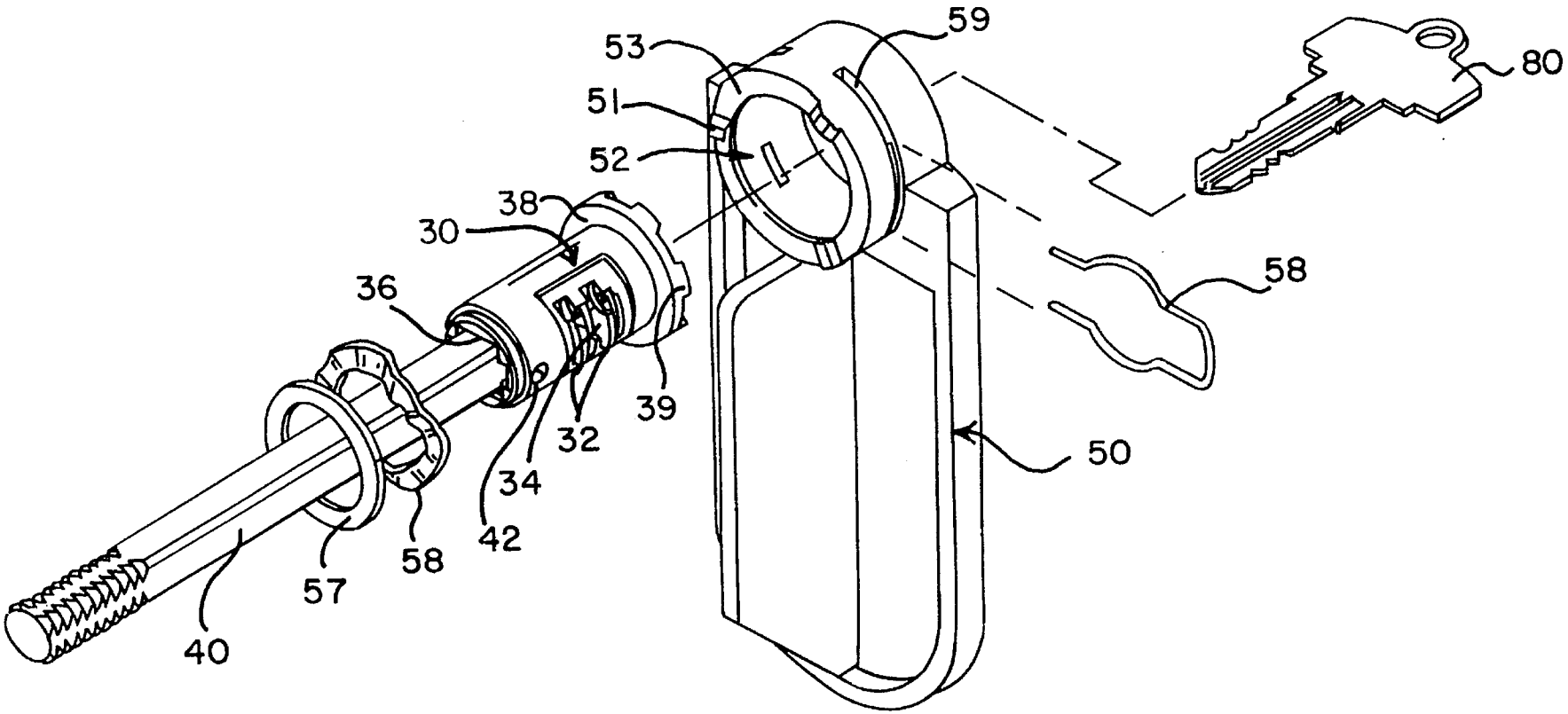
FIG. 5 is an exploded perspective view of one embodiment of the handle lock.
Figure 10:
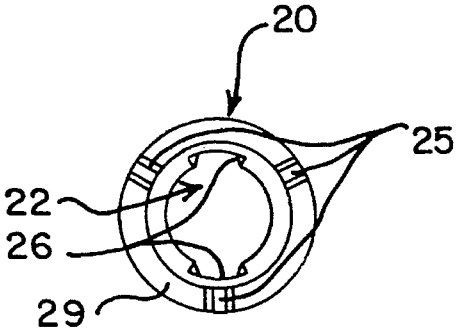
FIG. 10 is an end elevation view of the lock shell in one embodiment of the handle lock.

To provide for selective rotation of the lock plug 30 within the lock shell 20, the handle lock 10 includes tumbler means 32 disposed within the lock plug 30 which engage with longitudinal lock grooves 26 in the lock shell 20. As shown in FIG. 5, the tumbler means 32 are disposed in a key slot or tumbler receiving opening 34 located in the lock plug 30. In the present embodiment, the tumbler means 32 are conventional combinating tumblers which are paired for use with a double bitted key 80. In a conventional fashion, the tumblers 32 are normally biased outward beyond the perimeter of the lock plug 30 and into engagement with the longitudinally running locking grooves 26 in the lock shell 20. As shown in FIG. 10, the locking grooves 26 are separated by 180 degrees around the circumference of the lock shell 20. When the tumblers 32 are in the outwardly biased position and are engaged with the longitudinal locking grooves 26, the lock plug 30 cannot rotate within the lock shell 20. However, when the tumblers 32 are actuated by a properly coded double bitted key 80, they withdraw into the tumbler receiving opening 34 until they are flush with the exterior surface of the lock plug 30. When in this position, the tumblers 32 are no longer engaged with grooves 26 and the lock plug 30 is free to rotate within the lock shell 20. The key 80 is inserted through a key slot 34 which is centrally located on the front end of the lock plug 30.

Figure 11:
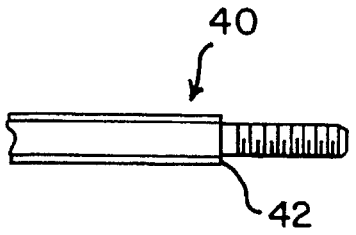
FIG. 11 is a fragmentary side elevation view of the shaft in one embodiment of the handle lock.
Figure 13:
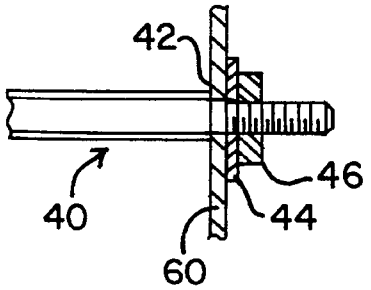
FIG. 13 is a fragmentary section view showing the connection between the shaft and the crank in one embodiment of the handle lock.
Figure 12:
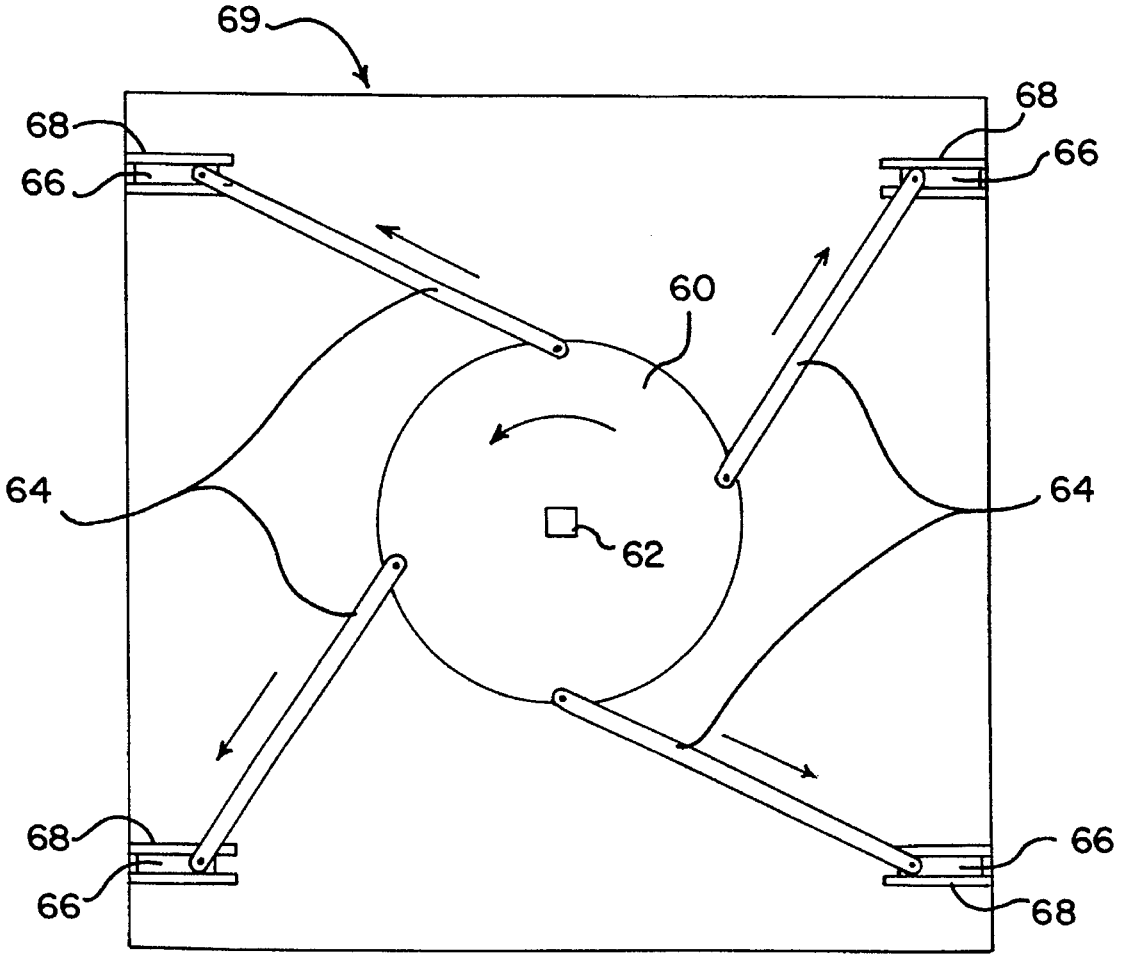
FIG. 12 is an environmental drawing showing the crank and link mechanism that controls the operation of the door latches in one embodiment of the handle lock.

As depicted in FIG. 5, the rear section of the lock plug 30 contains a rectangular opening 36 for receiving one end of a shaft 40. In the illustrated embodiment, the shaft 40 is secured in the rectangular opening by a pin 42. As shown in FIG. 12, the opposite end of the shaft 40 is connected to a crank 60 which is part of the mechanism for controlling the latches on the safe door or the like. As shown in FIG. 11, the shaft 40 is comprised of two sections of differing cross-sectional areas with a shoulder 42 separating the two sections. The section of the shaft 40 that is connected to the lock plug has a larger cross-sectional area than the section that is threaded. As shown in FIG. 12, the crank 60 contains a central throughbore 62 for receiving the threaded end of the shaft 40. The shaft 40 is formed with the shoulder 42 positioned such that when the crank 60 is properly secured on the shaft 40 by a conventional nut 46 and washer 44, the crank 60 abuts against the shoulder 42.

To provide for the opening and closing of the safe door or the like, one end of four separate links 64 are pivotally connected to the crank 60, as shown in FIG. 12. The opposite end of each of the links 64 is pivotally connected to one of four separate door latches 66. The door latches 66 are contained in horizontal slides 68 which are mounted to the safe door or the like 69. The links 64 and horizontal slides 68 translate the rotation of the crank 60 into a linear motion of the door latches 66. Depending on the direction of the rotation of the crank 60, the links 64 will either push the door latches 66 into engagement with complementary locking slots on the body of the safe or the like or pull the door latches 66 out of engagement. Thus, the rotation of the lock plug 30 within the lock shell 20 operates the door latches 66 due to the rigid connections between the lock plug 30 and the shaft 40 and the shaft 40 and the crank 60.

Figure 4:
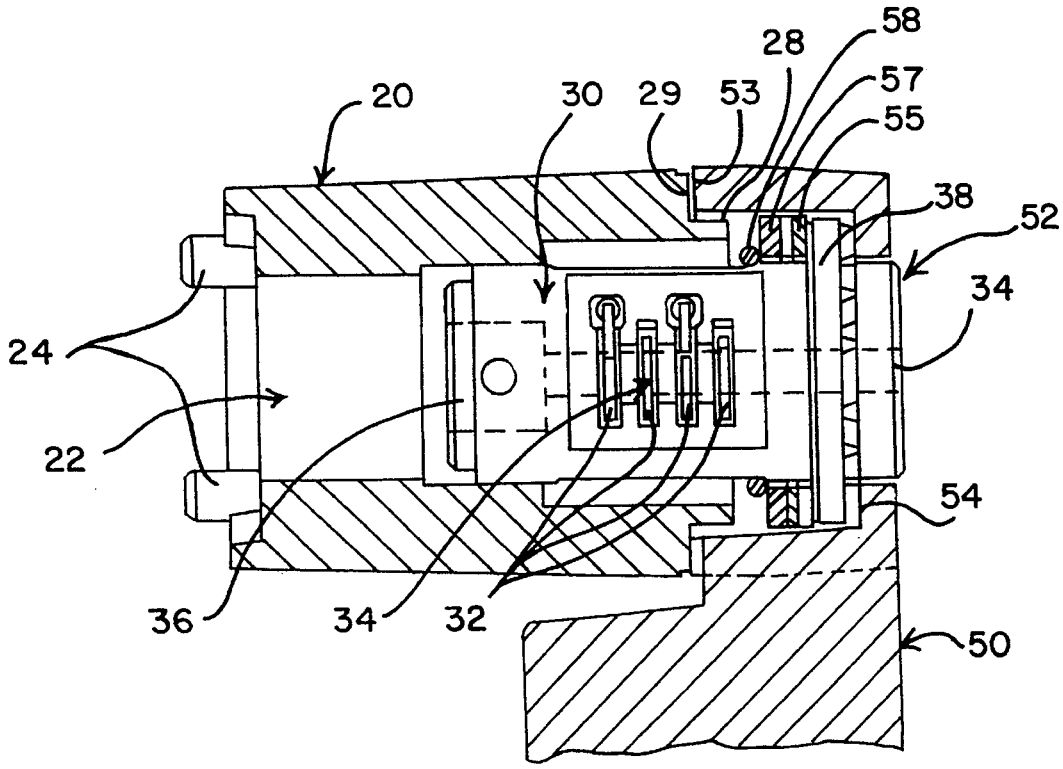
FIG. 4 is a section view of the handle, the lock shell and the lock plug without the shaft in one embodiment of the handle lock.
Figure 7:
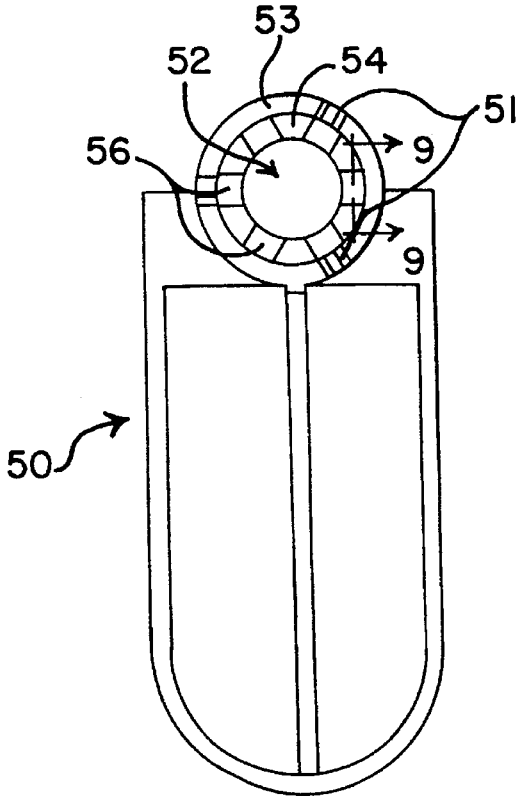
FIG. 7 is an elevation view of the handle of one embodiment of the handle lock.

Returning to FIG. 5, a handle 50 is connected to the front portion of the lock plug 30 to control the rotation of the lock plug 30 within the lock shell 20. The handle 50 is formed with a stem portion and a mounting throughbore 52 which is adapted to receive both the lock plug 30 and the lock shell 20. As depicted in FIG. 4, the mounting throughbore 52 has a front section with a first smaller diameter and a rear section with a second greater diameter. The front section of the mounting throughbore 52 is adapted to receive the key slot 34 end of the lock plug 30 so that the key slot 34 is flush with the outside surface of the handle 50. As shown in FIG. 7, there is an annular ledge 54 incorporating a series of connecting splines or grooves 56 at the transition between the front and rear sections of the mounting throughbore 52. In the illustrated embodiment there are six connecting splines 56 equally spaced around the annular ledge 54.

Figure 6:
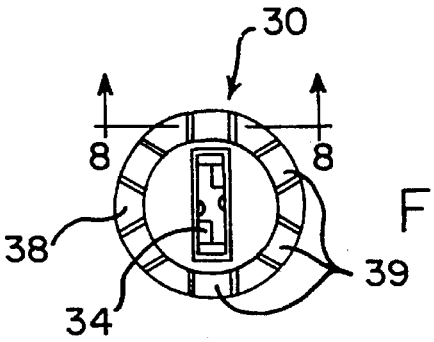
FIG. 6 is an end elevation view of the key slot end of the lock plug of one embodiment of the handle lock.

To secure the handle 50 to the lock plug 30, an annular flange 38 on the lock plug 30 is formed with connecting splines 39 which are complemental to the connecting splines on the handle, the complemental connecting splines on the lock plug illustratively being a series of connecting detents. As seen in FIG. 6, there are six complemental connecting splines 39 equally spaced around the annular flange 38. The connecting splines 56 in the handle and the complemental connecting splines 39 on the lock plug fit together in an interlocking relationship to form a breakaway interlocking connection between the handle 50 and the lock plug 30. Although this embodiment shows the connecting splines and complemental connecting splines as grooves and detents, respectively, the opposite could be true, or other spline configurations could be used. According to the invention, a breakaway interlocking connection is used so as to provide breakaway of the handle upon application of a substantial force to the handle. As shown in FIGS. 4 and 5, the connecting splines 56 and the complemental connecting splines 39 are held together in their interlocking relationship by a thrust washer 55, a conventional washer 57 and a hairpin 58 which is contained in a slot 59 in the side of the handle mounting throughbore 52.

Figure 8:
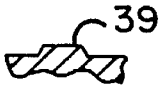
FIG. 8 is a section view taken substantially along line 8—8 in FIG. 6 showing one of the connecting splines formed on the lock plug in one embodiment of the handle lock.
Figure 9:
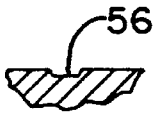
FIG. 9 is a section view taken substantially along line 9—9 in FIG. 7 showing one of the complementary connecting splines formed on the handle of one embodiment of the handle lock.

While the handle 50 will remain connected to the lock plug 30 during normal rotation of the handle 50, the connection is adapted to break away if someone attempts to forcibly open the handle lock 10 without using the key 80 by applying a substantial force such as might otherwise shear the tumblers, for example. As shown in FIG. 9, the connecting splines 56 on the annular ledge 54 are formed with slightly tapered sides. Likewise, the complemental connecting splines 39 on the annular flange 38 also have slightly tapered sides as shown in FIG. 8. These slightly tapered sides allow the connecting splines and complemental connecting splines forming the breakaway interlocking connection to slide out of their interlocking arrangement by a camming action when a significant turning force is applied to the handle 50 when the tumblers 32 are engaged with the locking grooves 26. The tapered sides are formed so that they are steep enough to ensure that the connecting splines and complemental connecting splines remain interlocked during normal rotation of the handle 50. However, the sides are sufficiently tapered to ensure that the breakaway interlocking connection will break away before a force is applied that is sufficient to shear the tumblers 32 inside the locking grooves 26 absent this breakaway feature.

As shown in FIGS. 2 and 4, the front end of the lock shell 20 is formed with an annular collar 28. The annular collar 28 is adapted to be inserted into the rear section of the handle mounting throughbore 52. The annular collar 28 prevents the handle 50 from moving laterally relative to the lock shell 20. As depicted in FIG. 4, when the annular collar 28 is fully inserted into the mounting throughbore 52, an annular shoulder 29 located adjacent to the annular collar 28 abuts against the rear lip 53 of the mounting throughbore 52.

In order to accurately align and hold the handle 50 in the open and closed positions, the annular shoulder 29 of the lock shell 20 is formed with positioning splines 25 illustratively in the form of multiple grooves. Additionally, as shown in FIG. 7, the rear lip 53 of the mounting throughbore 52 is provided with complemental positioning splines 51 illustratively in the form of multiple detents. In the illustrated embodiment, there are three positioning splines 25 separated by 120 degrees around the circumference of the annular shoulder and three complemental positioning splines 51 separated by 120 degrees around the circumference of the rear lip. The complemental positioning splines 51 and the positioning splines 25 are arranged so that they will engage when the handle 50 is rotated into either the open or closed position. Both the positioning splines 25 and the complemental positioning splines 51 are formed with tapered sides so that they can easily slide into and out of engagement when the handle 50 is turned.

The handle lock described herein thus provides a breakaway interlocking connection between the lock plug and the handle that prevents unauthorized entry by means of shearing the tumblers through forcible turning of the handle. Further, the use of engageable grooves and detents on the lock shell and handle allows the lock to be accurately aligned in the open and closed positions.

I claim as my invention:

1. A handle lock for a safe door or the like comprising in combination:

a lock shell having a substantially smooth cylindrical surface, a central throughbore, including longitudinal locking grooves, an annular collar and an annular shoulder;

a lock plug for selective rotation within said lock shell and having a front section including a tumbler-receiving opening, a key slot centrally located on an end and an annular flange and a rear section including a shaft receiving means;

a handle for controlling rotation of said lock plug and having a stem portion and a mounting throughbore portion for receiving said lock shell annular collar and said lock plug;

said mounting throughbore having a front section with a first smaller diameter, a rear section with a second greater diameter and an annular ledge between said front and rear sections;

a shaft connecting said lock plug to a door latch actuation means;

a tumbler means disposed in said tumbler-receiving opening for selective engagement with said longitudinal locking grooves, said tumbler means including coding for actuation by a properly coded key for disengagement from said locking grooves to allow for said selective rotation of said lock plug;

a breakaway interlocking connection between the lock plug and the handle, wherein said mounting throughbore annular ledge is formed with connecting splines and said lock plug is formed with complemental connecting splines on said lock plug annular flange, the connecting splines and complemental connecting splines being mutually engageable in order to secure said handle to said lock plug during turning of said handle and being formed with slightly tapered sides whereby said connecting splines and said complmental connecting spines slide out of engagement and allow said handle to rotate relative to said lock plug upon application of an excessive force to said handle while said tumbler means are engaged with said locking grooves;

means for biasing said mounting throughbore annular ledge and said lock plug annular flange, and thereby said connecting splines and said complemental connecting splines, into engagement; and positioning splines formed on said rear face of said mounting throughbore and complemental positioning splines formed on said lock shell shoulder, said positioning splines and complemental positioning splines being adapted such that said positioning splines and complemental positioning splines are mutually engaged when said handle is in either the open or closed position in order to maintain the handle in that position and said positioning splines and complemental positioning splines are mutually disengaged when said handle is being rotated.

2. The handle lock according to claim 1, wherein said complemental connecting splines on said lock plug annular flange and said connecting splines on said mounting throughbore annular ledge are formed with slightly tapered sides whereby said connecting splines and said complemental connecting splines slide out of engagement upon application of a substantial force applied to said handle while said tumbler means are engaged with said locking grooves.

3. The handle lock according to claim 1, wherein said shaft is formed with two sections of differing cross-sectional areas separated by a shoulder and said shaft is adapted so that said door latch activation means abuts against said shoulder when said door latch activation means is connected to said shaft.

4. The handle lock according to claim 1, wherein said lock shell is formed with multiple mounting posts on the end opposite said annular collar and said annular shoulder.

5. The handle lock according to claim 1, wherein the biasing means includes a hairpin, a washer and a thrust washer, and wherein said handle throughbore includes a slot, the hairpin being receivable in said slot, said thrust washer and washer being disposed around the lock plug and maintained in position by the hairpin for biasing the connecting splines and complemental connecting splines into engagement.

* * * * *

UNITED STATES PATENT AND TRADEMARK OFFICE

CERTIFICATE OF CORRECTION

PATENT NO. : 5,619,874

DATED : April 15, 1997

INVENTOR(S) : Myers

It is certified that error appears in the above-identified patent and that said Letters Patent is hereby corrected as shown below: On the title page, item [22]

should read "Jun. 5, 1996" instead of "Jun. 5, 1995."

Signed and Sealed this

Fifteenth Day of June, 1999

*Attest:*

Q. TODD DICKINSON

*Attesting Officer*

*Acting Commissioner of Patents and Trademarks*